US009797246B2

(12) United States Patent
Lehnert et al.

(10) Patent No.: US 9,797,246 B2
(45) Date of Patent: Oct. 24, 2017

(54) CHISEL HOLDER

(71) Applicant: Wirtgen GmbH, Windhagen (DE)

(72) Inventors: Thomas Lehnert, Oberraden (DE); Karsten Buhr, Willroth (DE); Cyrus Barimani, Königswinter (DE)

(73) Assignee: Wirtgen GmbH (DE)

( * ) Notice: Subject to any disclaimer, the term of this patent is extended or adjusted under 35 U.S.C. 154(b) by 325 days.

(21) Appl. No.: 14/371,776

(22) PCT Filed: Jan. 25, 2013

(86) PCT No.: PCT/EP2013/051426

§ 371 (c)(1),
(2) Date: Jul. 11, 2014

(87) PCT Pub. No.: WO2013/127578

PCT Pub. Date: Sep. 6, 2013

(65) Prior Publication Data

US 2015/0028654 A1 Jan. 29, 2015

(30) Foreign Application Priority Data

Mar. 1, 2012 (DE) ..... 10 2012 101 719

(51) Int. Cl.
*E21C 35/183* (2006.01)
*E21C 35/18* (2006.01)
(Continued)

(52) U.S. Cl.
CPC ..... *E21C 35/18* (2013.01); *B28D 1/186* (2013.01); *E01C 23/088* (2013.01); *E21C 25/10* (2013.01);
(Continued)

(58) Field of Classification Search
CPC ..... E21C 35/183; E21C 2035/1803; E21C 2035/1806; E21C 2035/1809;
(Continued)

(56) References Cited

U.S. PATENT DOCUMENTS 1,835,701 A 12/1931 Edmunds
1,965,950 A 7/1934 Walker
(Continued)

FOREIGN PATENT DOCUMENTS

DE 2931785 A1 2/1981
DE 3929609 A1 4/1990
(Continued)

OTHER PUBLICATIONS

International Search Report in corresponding International Application No. PCT/EP2013/051426, dated Jan. 27, 2014, 3 pp. (not prior art).

*Primary Examiner* — David Bagnell
*Assistant Examiner* — Michael Goodwin
(74) *Attorney, Agent, or Firm* — Lucian Wayne Beavers; Patterson Intellectual Property Law, PC

(57) ABSTRACT

The invention relates to a bit holder for an earth working machine, in particular a surface miner, a road milling machine, or the like, having a holding projection that comprises a bit receptacle and/or carries a cutting element. In order to improve the operating reliability of an earth working machine, provision is made according to the present invention that the holding projection has, behind the cutting element or behind a receiving region of the bit receptacle in the tool advance direction, a wear protection element having a hard-material element in order to provide an emergency-mode property.

26 Claims, 9 Drawing Sheets

Figure 1:
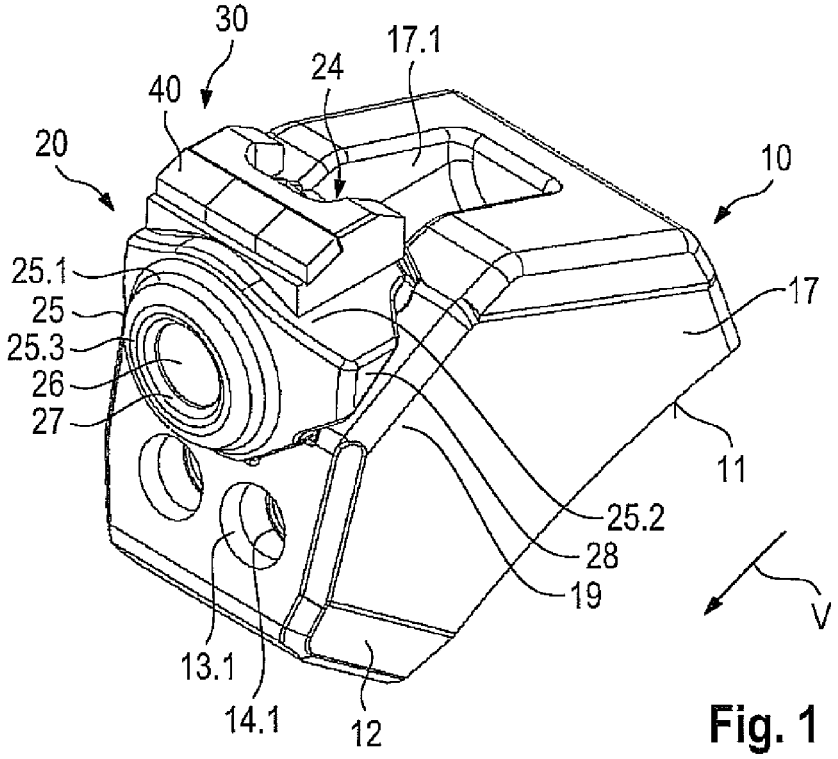

(51) Int. Cl.
*E21C 25/10* (2006.01)
*B28D 1/18* (2006.01)
*E01C 23/088* (2006.01)

(52) U.S. Cl.
CPC .... *E21C 35/183* (2013.01); *E21C 2035/1806* (2013.01); *E21C 2035/1809* (2013.01)

(58) Field of Classification Search
CPC ..... E21C 2035/1813; E21C 2035/1816; B28D 1/186; B28D 1/188
See application file for complete search history.

(56) References Cited

U.S. PATENT DOCUMENTS

| | | | | |
|---|---|---|---|---|
| 4,091,692 | A | 5/1978 | Wrulich et al. | |
| 4,159,746 | A | 7/1979 | Wrulich et al. | |
| 4,932,723 | A | 6/1990 | Mills | |
| 5,251,964 | A | 10/1993 | Ojanen | |
| 5,415,462 | A * | 5/1995 | Massa | E21C 35/197 299/106 |
| 5,683,144 | A | 11/1997 | Kammerer et al. | |
| 6,585,327 | B2 | 7/2003 | Sollami | |
| 6,592,304 | B1 | 7/2003 | Kammerer | |
| 7,413,256 | B2 * | 8/2008 | Hall | E21C 35/183 299/104 |
| 8,746,807 | B2 | 6/2014 | Lehnert et al. | |
| 2002/0070602 | A1 | 6/2002 | Sollami | |
| 2008/0164747 | A1 * | 7/2008 | Weaver | E21F 5/00 299/10 |
| 2009/0146491 | A1 * | 6/2009 | Fader | B28D 1/186 299/105 |
| 2009/0256413 | A1 * | 10/2009 | Majagi | B28D 1/188 299/100 |
| 2010/0194176 | A1 * | 8/2010 | Lucek | E21C 35/183 299/29 |
| 2011/0204702 | A1 | 8/2011 | Lehnert et al. | |
| 2011/0241407 | A1 | 10/2011 | Fader et al. | |
| 2013/0052481 | A1 * | 2/2013 | Konyashin | B22D 19/14 428/679 |

FOREIGN PATENT DOCUMENTS

| | | | | |
|---|---|---|---|---|
| DE | 4322401 | A1 | 1/1995 | |
| DE | 4416250 | C1 | 11/1995 | |
| DE | 19924683 | A1 | 11/2000 | |
| DE | 202005013235 | U1 | 1/2006 | |
| DE | 102009059189 | A1 | 6/2011 | |
| DE | WO 2011128250 | A1 * | 10/2011 | B22D 19/14 |
| GB | 2055928 | A | 3/1981 | |
| SU | 1102936 | A | 7/1984 | |
| WO | 2009142577 | A1 | 11/2009 | |
| WO | 2010025788 | A1 | 3/2010 | |

* cited by examiner

CHISEL HOLDER

The invention relates to a bit holder for an earth working machine, in particular a surface miner, a road milling machine, or the like, having a holding projection that comprises a bit receptacle and/or carries a cutting element.

The invention further relates to a carrier for a bit holder, and to a mining machine or similar earth working machine.

DE 43 224 01 A1 discloses a bit holder changing system having a base part and a bit holder. The base part comprises a support foot with which it can be welded onto the outer periphery of a milling drum. An insertion receptacle is recessed into the base part. A bit holder can be installed with its insertion projection into this receptacle. A compression screw, which pulls the insertion projection into the insertion receptacle and clamps it therein, is used to secure the bit holder in the base part. The bit holder possesses, as a bit receptacle, an orifice in which a bit, in particular a round shank bit, can be replaceably installed.

DE 10 2009 059 189 A1 discloses a further bit holder changing system that is based on a similar basic construction principle, having a base part and a bit holder. The solid embodiment shown here is usually used in surface miners. The base parts are again installed on a tubular milling drum and arranged with respect to one another so that they form helical clearing and loading screws on the milling drum surface. During processing engagement, the bits cut into the material to be removed, for example a coal seam. The bit continuously wears away as a result of the abrasive attack, with the result that its axial head length decreases. As soon as the bit has reached its wear limit, it must be replaced in order to avoid damage to the bit holder and/or to the base part. It can happen, however, that the milling machine unexpectedly encounters a hard mineral layer, whereupon a bit occasionally breaks. The bit holder is then exposed without protection to wear attack, and after only a short time is incapable of receiving a replacement bit. The bit holder must then be cost-intensively replaced. If the base part is also worn out, it too must be detached from the tubular milling drum and replaced, the expenditure of cost and time then being considerably greater.

If the wear state of the bit is not detected in timely fashion, or if a bit breakage occurs, high tool costs as well as machine down times then result. Such machine down times are, however, very cost-intensive and therefore need to be minimized.

The object of the invention is to improve the operating reliability of an earth working machine.

This object is achieved in that the holding projection of the bit holder comprises or carries, behind the cutting element or behind a receiving region of the bit receptacle in the tool advance direction, a wear protection element having a hard-material element in order to provide an emergency-mode property.

If, during operational use, the wear state of the bit is not detected in timely fashion or if a bit breaks, the wear protection element with its hard-material element takes over the emergency-mode property and prevents severe damage to the bit holder due to abrasive attack. The functionality of the bit holder is thus retained and the machine operator can quickly replace the defective bit with no need for long machine down times due to replacement of the bit holder or even of the base part.

According to a preferred inventive variant, provision can be made that the hard-material element butts against the radially externally located body region of the holding projection comprising the bit receptacle or projects radially beyond it; or that the hard-material element is arranged set back in a radial direction with respect to the cutting element. The bit holders are usually arranged on a tubular milling drum and thus proceed in a circle. During tool engagement as intended, the bit or the cutting element cuts into the material to be removed and the wear protection element with its hard-material element runs along passively with no cutting engagement. Only when the bit or cutting element has reached its wear state or when a tool break occurs does the hard-material element come into working engagement, as intended, with the substrate to be removed.

If provision is furthermore made that the hard-material element has a cutting edge, material removal can then also be accomplished with the wear protection element during emergency engagement, and furthermore the penetration resistance of the wear protection element is reduced. Excessive stress on the bit holder is thereby prevented.

An effective cutting-edge geometry results when provision is made that the cutting edge is arranged between a front side facing in the tool advance direction and a top side; and in particular that the angle enclosed between the front side and the top side for formation of the cutting edge is selected to be between 60° and 130°. An angle range between 90° and 120° is particularly preferred, since a good compromise is arrived at here for a cutting-edge geometry that is sufficiently stable and free-cutting. According to an inventive embodiment, provision can be made that the longitudinal center axis of the bit receptacle and the front side facing in the tool advance direction enclose an angle β in the angle range between 40° and 130°, particularly preferably an angle in the angle range between 60° and 110°. This yields a front-side incidence that can reliably dissipate even load peaks occurring in pulsed fashion, in order to maintain the emergency-mode function.

Provision is made particularly preferably that two or more hard-material elements juxtaposed in particular in substantially gap-free fashion are used. The use of multiple hard-material elements instead of one large continuous hard-material element decreases the risk of breakage for the hard-material element. The gap-free juxtaposition prevents erosion of the interstices between the individual hard-material elements, so that the fastening of the hard-material elements is reliably maintained.

Stable securing of the hard-material elements is achieved in simple fashion if provision is made that the hard-material element is fastened in a receptacle of the bit holder or of a carrier connectable or connected to the bit holder, and is braced positively, oppositely to the tool advance direction, against a supporting surface; and/or that the hard-material element is braced positively, in the tool advance direction, against a step.

The hard-material elements can be secured by means of a solder connection or the like. The load on this connection is relieved by the back-side bracing and/or front-side step.

Carbide, ceramic material, or another material that acts functionally identically can be used as a hard material for the hard-material element.

An inventive alternative can be such that a carrier that receives the hard-material element is replaceably connected, in particular is welded, to the bit holder. The variability of the tool system is thereby further simplified. In particular, existing bit holders can be retrofitted with a carrier of this kind. For example, if in the event of damage a bit breakage is not detected in timely fashion, the wear protection element then wears away. The complete bit holder with the carrier is then replaced and a new, unworn bit holder is inserted, so that only short machine down times result. The carrier can then be separated from the bit holder and a new, unworn carrier can be connected again to the same bit holder in order to produce a completely ready-to-use bit holder.

A particularly rigid geometry that can absorb even severe load impacts results from the fact that the carrier comprises a base part that receives the hard-material element; and that one or two supporting parts are attached, oppositely to the tool advance direction, to the base part. On the one hand large connecting surfaces can be created using the supporting parts, or alternatively the connecting geometry with the supporting parts can be designed so that large torques can be transferred.

One conceivable inventive variant is such that the carrier comprises, in the attachment region to the bit holder, a concave hollow that comprises a placement surface for attachment to a corresponding, in particular convex, enveloping surface of the bit holder. Thanks to these surface pairings, on the one hand a correctly positioned correlation of the carrier with the bit holder can be simply and quickly achieved. On the other hand, the hollowed embodiment of the carrier makes possible the creation of a positive connection in the transverse direction of the hollow.

Rapid and reliable securing of the carrier to the bit holder is enabled by the fact that the carrier is equipped on its edge regions, at least locally, with a chamfer serving as a weld bead preparation.

Also a subject of the invention is a carrier for a bit holder having a wear protection element comprising a hard-material element, the carrier comprising a placement surface by way of which it is replaceably connectable to the bit holder. To avoid repetition, reference is made to the statements above and in particular to the emergency-mode property achievable with the carrier.

A further subject of the invention is an earth working machine, in particular a mining machine or the like, that is equipped with multiple bit holders as described above. In an earth working machine of this kind, provision can be made in particular that the radially outer boundary of the hard-material element is arranged on a first reference circle having a first radius, and the radially outer boundary of the cutting element is arranged on a third reference circle having a third radius; and that the first radius of the first reference circle is smaller than the third radius of the third reference circle. This configuration ensures that the hard-material element comes into working engagement only in the event of wear or of damage to the cutting element, as has already been explained previously.

Figure 2:
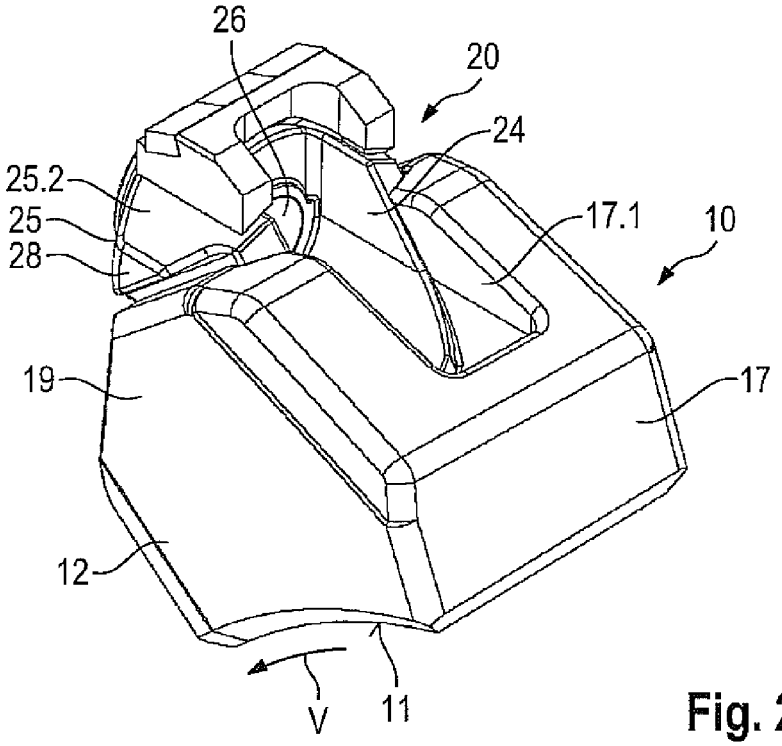
Figure 3:
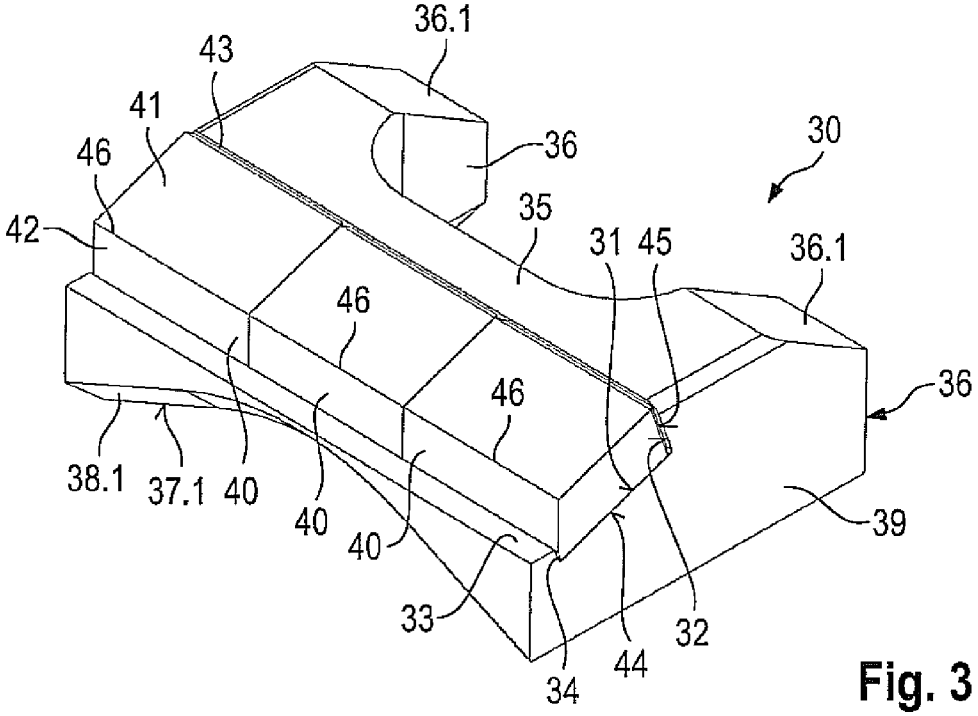
Figure 4:
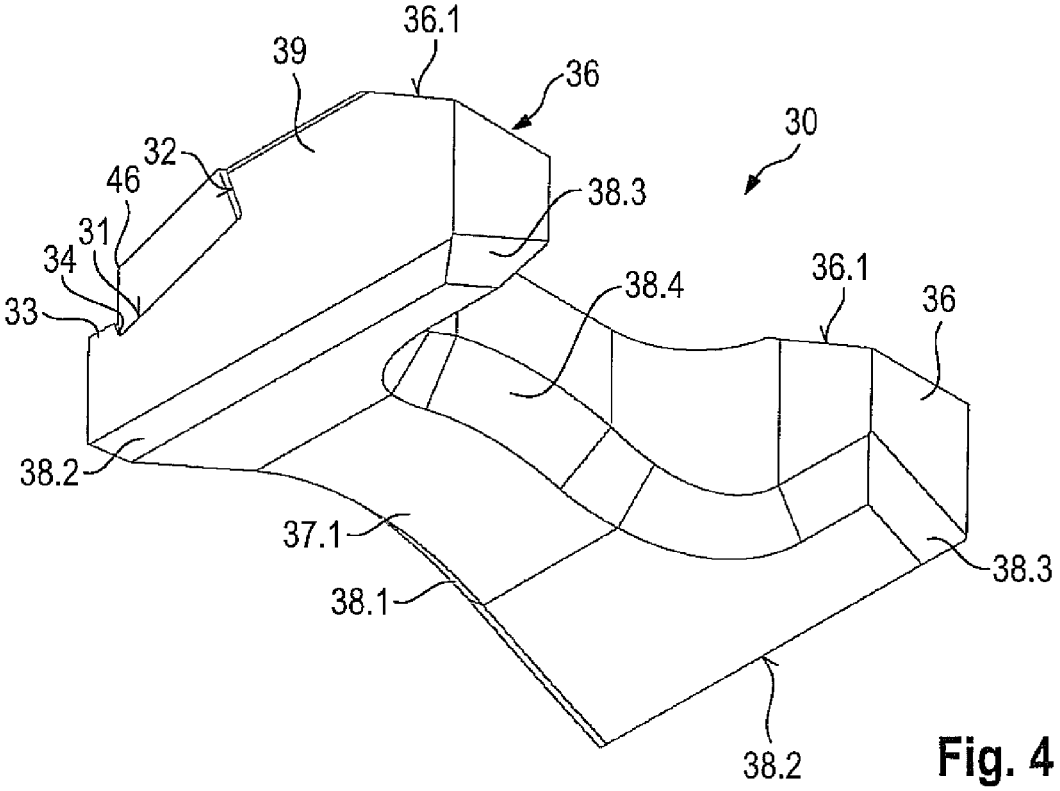
Figure 5:
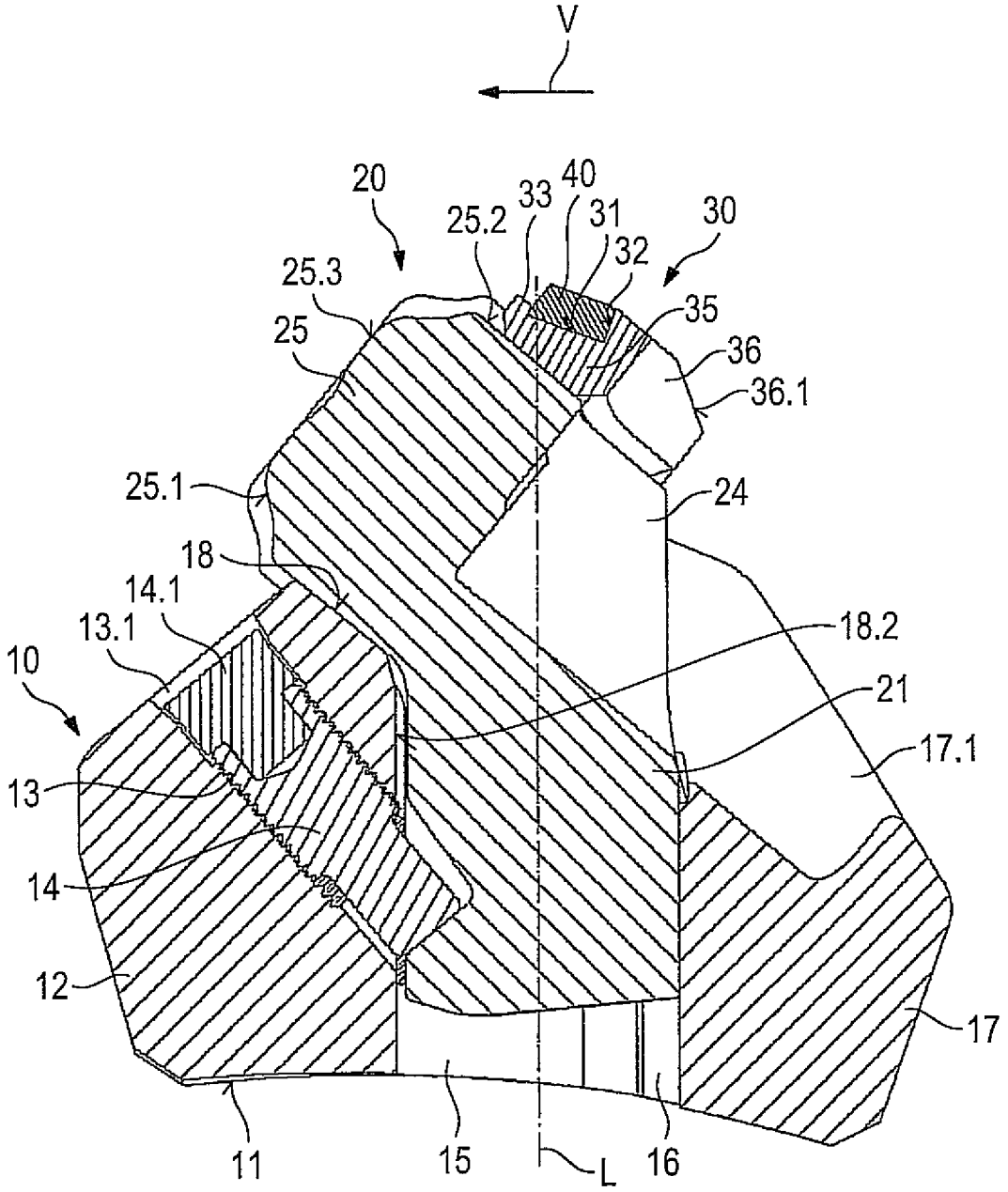
Figure 6:
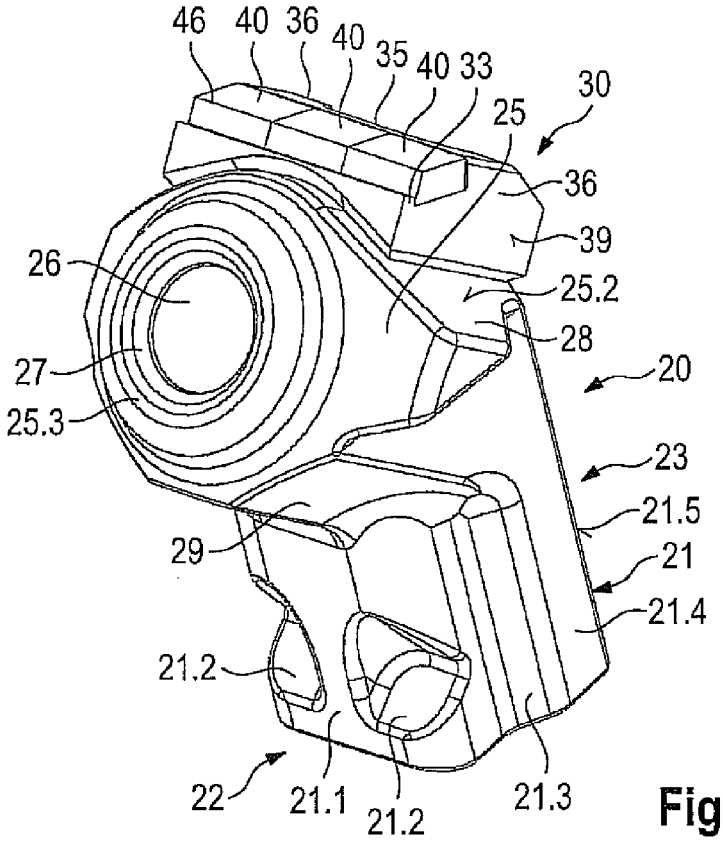
Figure 7:
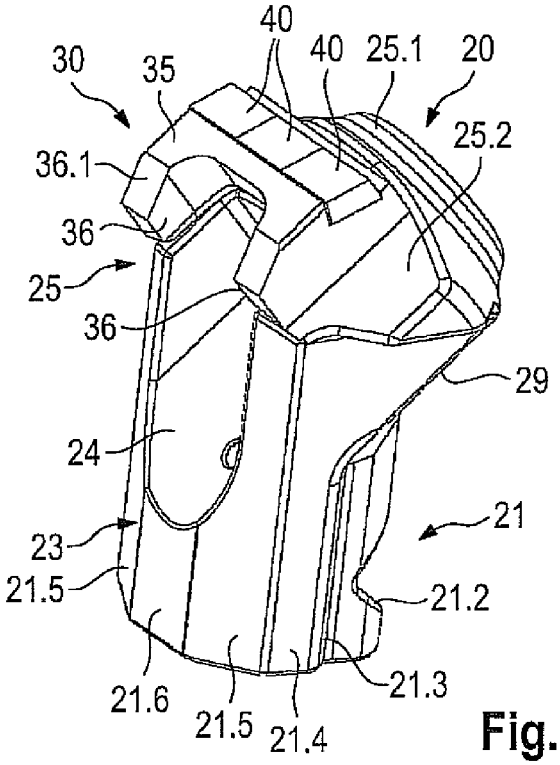
Figure 8:
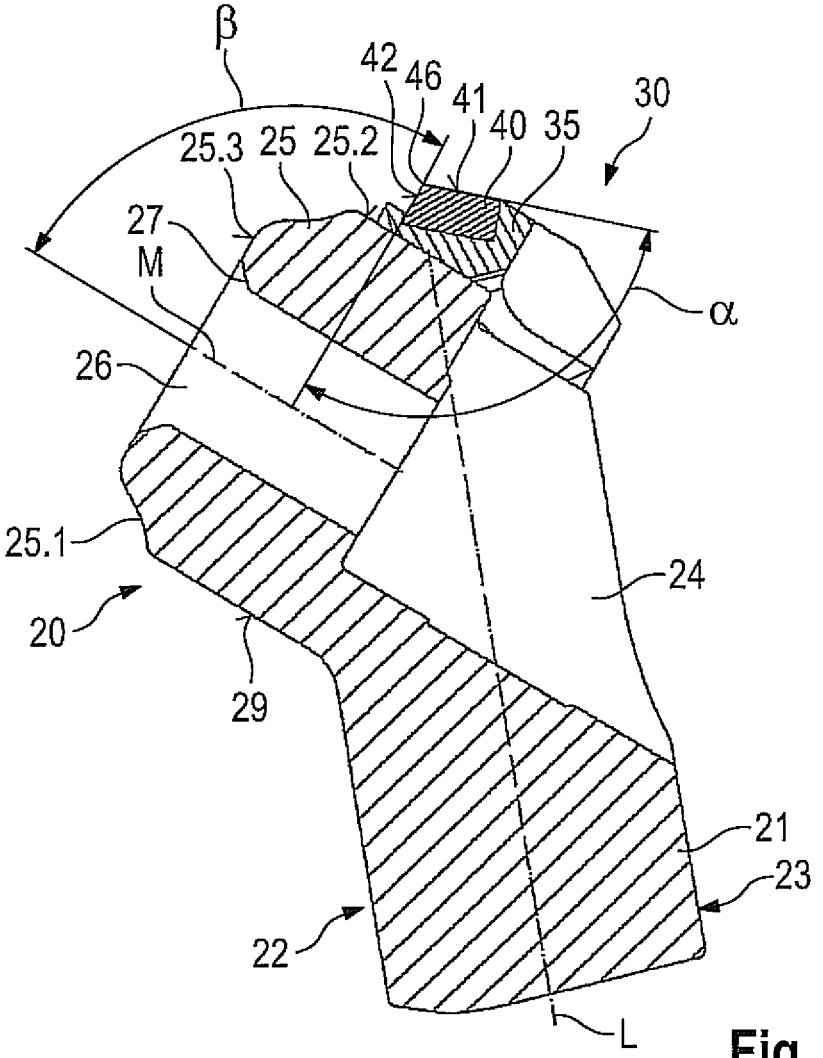
Figure 9:
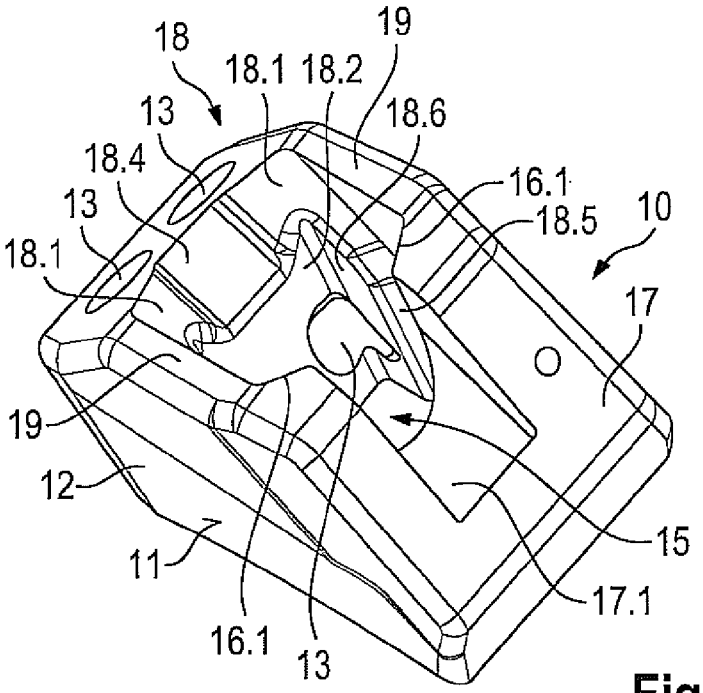
Figure 10:
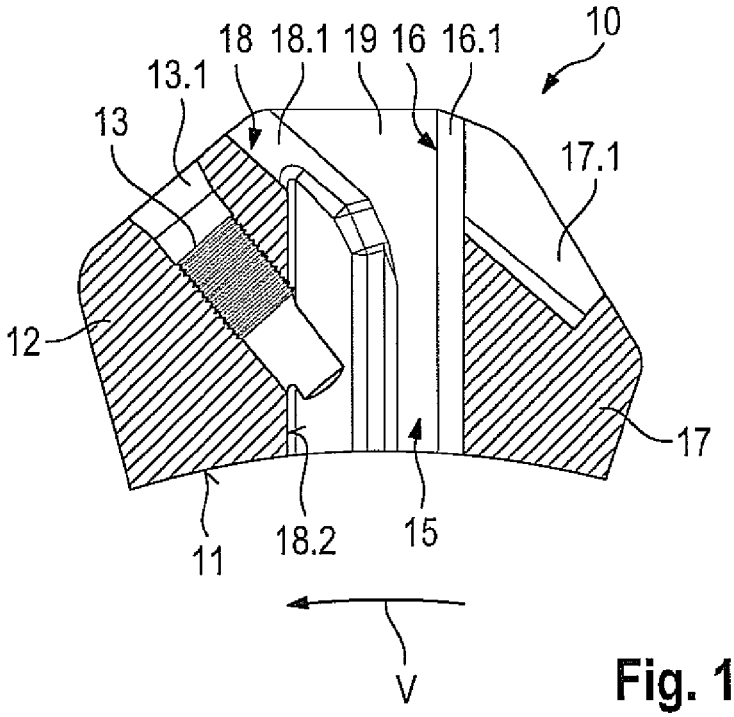
Figure 11:
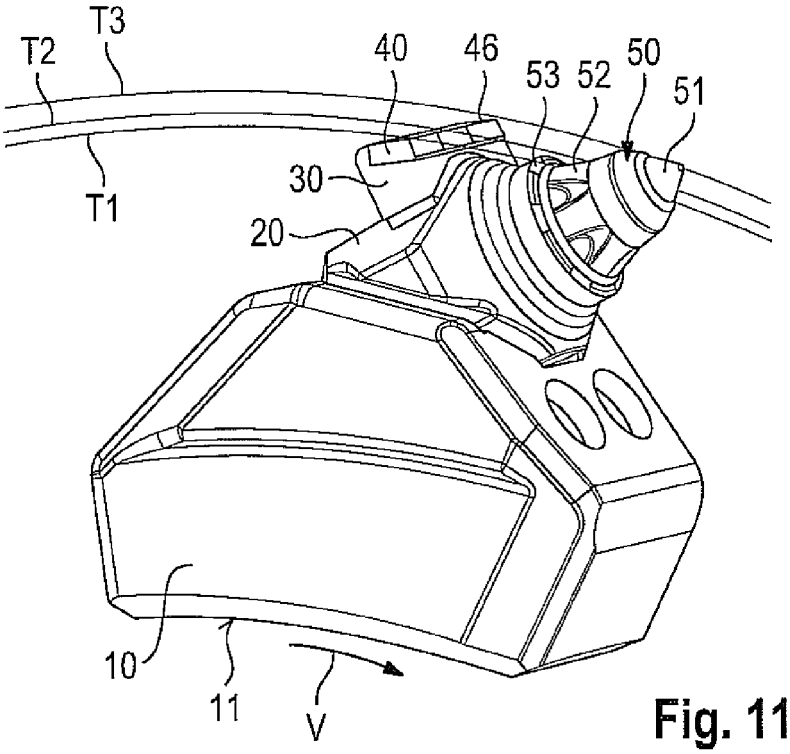
Figure 12:
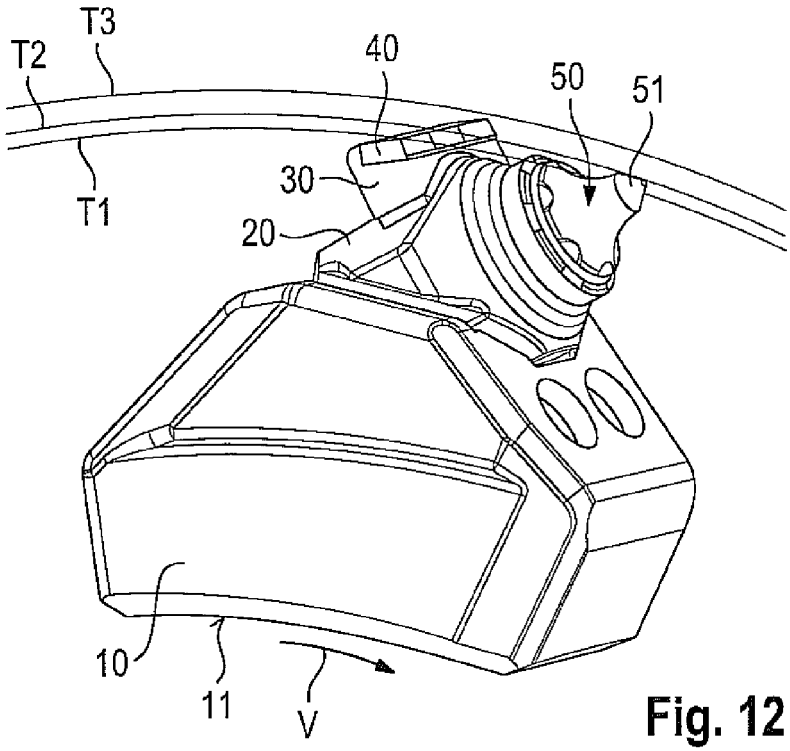
Figure 13:
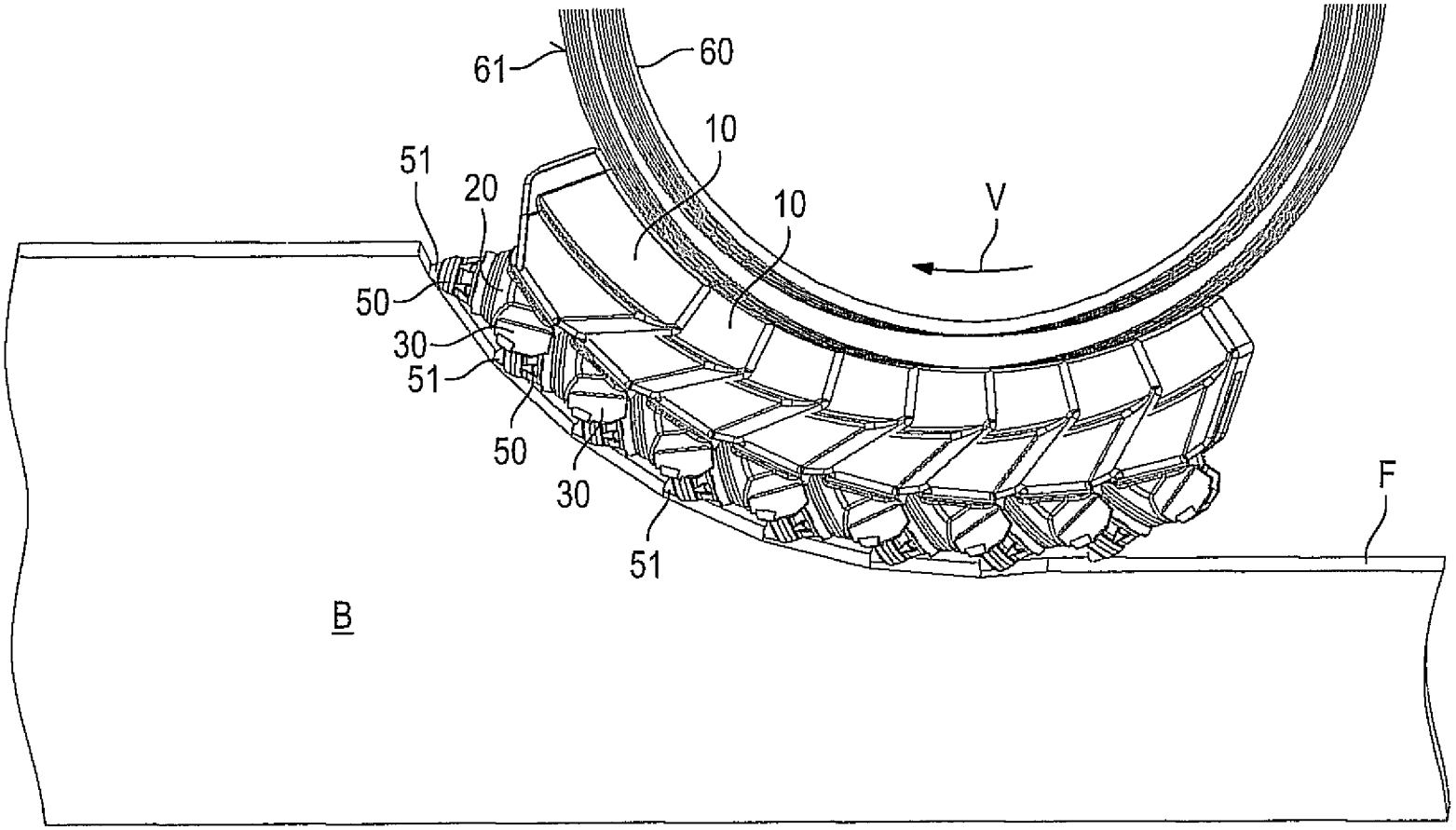
Figure 14:
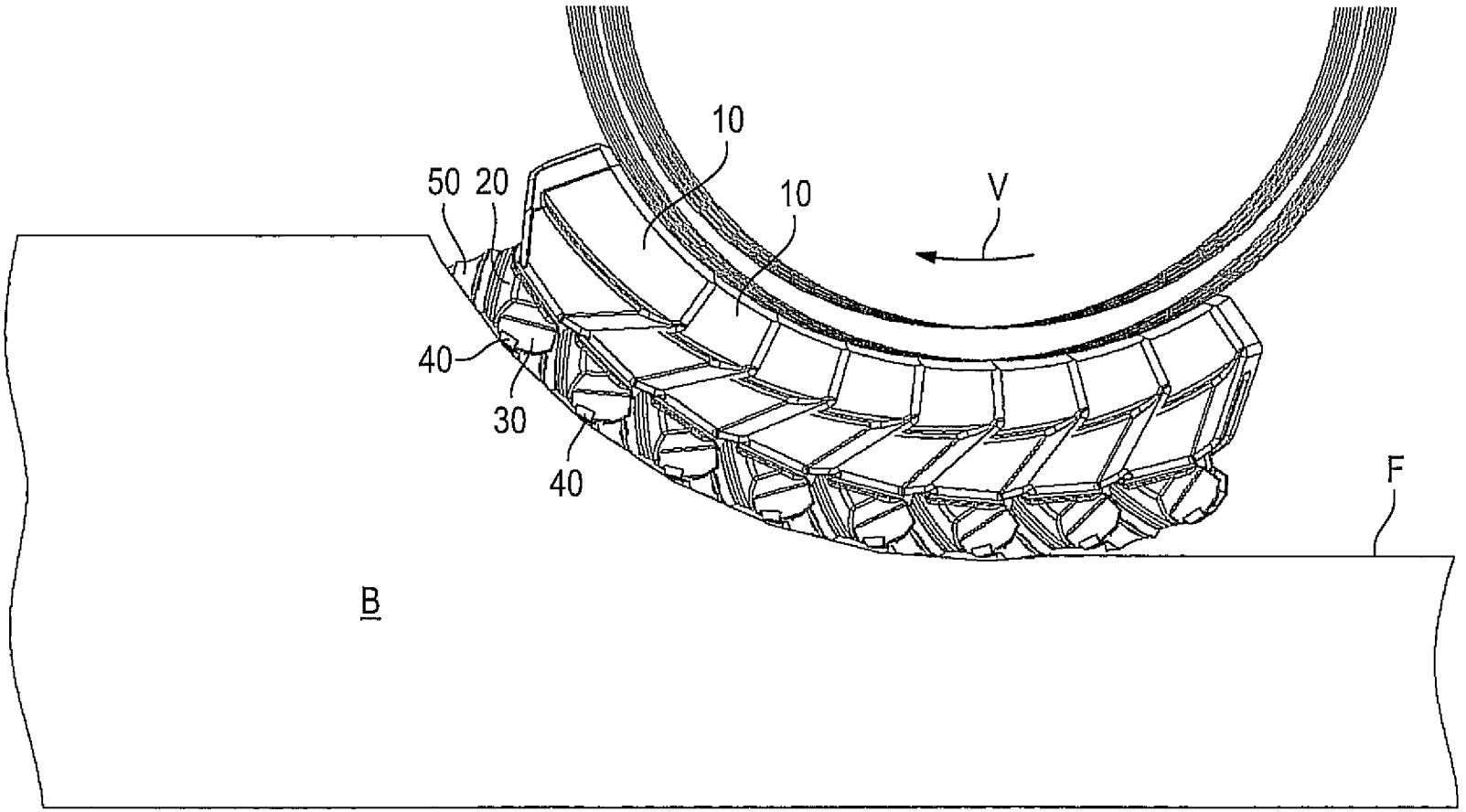

The invention will be further explained below with reference to an exemplifying embodiment depicted in the drawings, in which:

FIG. 1 is a perspective front view of a tool combination having a base part and a bit holder, FIG. 2 is a perspective rear view of the tool combination according to FIG. 1, FIG. 3 is a perspective front view of a wear protection element, FIG. 4 is a perspective view from below of the wear protection element in accordance with FIG. 3, FIG. 5 is a vertical section through the tool combination in accordance with FIG. 1 and FIG. 2, FIG. 6 is a perspective front view of the tool holder in accordance with the tool combination according to FIGS. 1, 2, and 5, FIG. 7 is a perspective rear view of the bit holder in accordance with FIG. 6, FIG. 8 is a vertical section through the bit holder, FIG. 9 is a perspective top view of the base part in accordance with FIGS. 1 and 2, FIG. 10 is a vertical section through the base part in accordance with FIG. 9, FIG. 11 shows the tool combination in accordance with FIGS. 1 and 2 with an inserted round shank bit in the unworn state, FIG. 12 shows what is depicted in FIG. 11, with a worn round shank bit, FIG. 13 shows the cutting unit of an earth working machine having a cutting drum on whose surface a plurality of tool systems in accordance with FIGS. 1 and 2 are installed, and FIG. 14 shows what is depicted in FIG. 13, in a worn state.

FIG. 1 shows a base part 10 that comprises an underside 11 having concavely curved placement surfaces. By means of these placement surfaces, the base part can be placed onto the cylindrical outer periphery of a milling drum and fixedly welded thereonto. A bit holder 20 is connected to base part 10.

As FIG. 5 shows, base part 10 comprises an insertion receptacle 15 that receives an insertion projection 21 of bit holder 20. The configuration of bit holder 20 will be described in further detail below with reference to FIG. 6 through FIG. 8.

As FIG. 6 shows, bit holder 20 comprises insertion projection 21, which is adjoined in angled fashion by a holding protection 25. Ideally, an oblique angle is enclosed between insertion projection 21 and holding projection 25. Insertion projection 21 forms, in the region of its insertion projection front side 22 facing in the tool advance direction (V), a front surface 21.1. Two cutouts are recessed into this front surface 21.1 in such a way that they form pressure surfaces 21.2. Pressure surfaces 21.2 are arranged at an angle to the longitudinal axis of insertion projection 21. The protrusion of insertion projection 21 which carries pressure surface 21.2 transitions via lateral transition segments 21.3 into lateral surfaces 21.4. Lateral surfaces 21.4 are aligned in the direction of the tool advance direction (V) and face toward the tool sides. As is evident from FIG. 7, lateral surfaces 21.4 transition, in the region of insertion projections 23, into bearing surfaces 21.5. Bearing surfaces 21.5 are at an angle to one another. Bearing surfaces 21.5 are in turn connected by means of a transition surface 21.6 and face oppositely to tool advance direction V.

Holding projection 25 is equipped with a bit receptacle 26 in the form of a cylindrical orifice. Longitudinal center axis M of bit receptacle 26 and longitudinal axis L of insertion projection 21 ideally enclose an angle in the range between 100° and 160°, preferably 130°. Bit receptacle 26 transitions via an introduction enlargement 27 into an abutting surface 25.3. Abutting surface 25.3 extends radially with respect to bit receptacle 26. The abutting surface 25.3 may also be referred to as a forward end face 25.3 of the holding projection 25. Facing away from bit receptacle 26, abutting surface 25.3 transitions into a cross-sectional constriction 25.1. Cross-sectional constriction 25.1 is embodied in the shape of a truncated cone and transitions an enveloping surface 25.2 of the bit holder into abutting surface 25.3. Holding projection 25 comprises, in the region below bit receptacle 26, two supporting surfaces 29 that are incident to one another at a V-shaped angle. As may be gathered from FIG. 8, supporting surfaces 29, because of their oblique incidence, face toward the free end of the insertion projection and at the same time in the tool advance direction (V), and (as depicted in FIG. 3) extend parallel or substantially parallel to the longitudinal center axis (M) of bit receptacle 26. As may be gathered from FIG. 7, holding projection 25 possesses lateral enlargements 28 into which supporting surfaces 29 transition. Supporting surfaces 29 and bearing surfaces 21.5 are oriented to face in mutually opposite directions.

As FIGS. 1 and 2 show, a wear protection element, whose more detailed configuration is apparent from FIGS. 3 and 4, is connected to holding projection 25 of bit holder 20. As these illustrations show, the wear protection element comprises a carrier 30 that is fabricated from a steel material. Carrier 30 comprises a base part 35 into which a receptacle 31 in the form of a milled recess is incorporated. The receptacle 31 may also be referred to as a recess 31. Receptacle 31 is bounded by a back-side supporting surface 32 and a front-side step 34. A placement surface of receptacle 31 extends between the back-side supporting surface 32 and step 34. Three hard-material elements 40 are soldered into receptacle 31. Hard-material elements 40 are embodied as plate-shaped components that are placed with their underside 44 onto the placement surface of receptacle 31. The placement surface of receptacle 31 which is engaged by the underside 44 of hard-material elements 40 as seen in FIG. 3, may be referred to as a recess bottom of the receptacle or recess 31. As can be seen in both FIGS. 3 and 4, the recess bottom slopes downwardly and forwardly toward the underside 37.1 of the carrier 30. At the back side, hard-material elements 40 are braced with a back side 45 with respect to supporting surface 32. At the front side they are braced against step 34. Hard-material elements 40 are juxtaposed in receptacle 31 in gap-free fashion and are secured in receptacle 31 by means of an intermaterial connection, for example a solder connection or an adhesive connection.

Hard-material elements 40 possess a top side 41 that adjoins a front side 42 in an angle range $\alpha$ between 60° and 150° (see FIG. 8). Front side 42 encloses with longitudinal center axis M of bit receptacle 26 an angle $\beta$ in the angle range between 40° and 130° (see FIG. 8). A cutting edge 46 is formed in the transition region between front side 42 and top side 41. Cutting edges 46 of the individual hard-material elements 40 are flush with one another, as may be gathered from FIG. 3. A bevel 43 is applied in the region at which top side 41 adjoins back side 45 in order to decrease the risk of breakage of hard-material element 40.

Hard-material element 40 is made of carbide, of a ceramic material, or of an equivalent hard material.

As FIG. 3 further shows, the front-side step 34 is formed by a projection 33 that covers the transition region between hard-material element 40 and the placement surface of receptacle 31 toward the front side. The intermaterial connection, in particular a solder connection, is thereby protected from erosion.

Attached to base part 35 oppositely to tool advance direction V are two limb-shaped supporting parts 36. The correlation with respect to base part 35 here is such that continuous lateral surfaces 39 proceeding in the direction of tool advance direction V are produced. Supporting parts 36 are bounded toward the upper side by an inclined oblique surface 36.1. In the region of the underside, carrier 30 is equipped with a concave hollow, as may be gathered from FIG. 4. The hollow forms a placement surface 37.1 that is surrounded peripherally by bevels that serve as weld bead preparations 38.1 to 38.4.

With placement surface 37.1, carrier 30 can be placed onto a convex enveloping surface 25.2 of holding projection 25, as shown in FIGS. 1 and 2. In order to secure carrier 30, a weld bead is introduced in the region of weld bead preparations 38.1 to 38.4.

In the installed state, cutting edges 46 are arranged transversely to tool advance direction V. Cutting edges 46 furthermore protrude in a radial direction beyond the front-side receiving region of bit receptacle 26, as may be gathered from FIG. 6. Cutting edge 46 accordingly protrudes radially beyond the outer boundary of bit holder 20, which in the present case is constituted by cross-sectional constriction 25.1 (FIG. 8).

The configuration of base part 10 will be further explained below with reference to FIGS. 9 and 10.

Base part 10 comprises an insertion receptacle 15 that is embodied in terms of its cross section in a manner adapted to the outer contour of insertion projection 21 of bit holder 20. Insertion receptacle 21 is bounded at the front side by means of a supporting projection 12.

A screw receptacle 13, constituting a thread, is recessed into supporting projection 12. Screw receptacle 13 opens into insertion receptacle 15. Facing away from insertion receptacle 15, screw receptacle 13 transitions into an orifice enlargement 13.1. Supporting projection 12 comprises in its upper, radially externally located region a support mount 18 that is constituted by two supporting surfaces 18.1. The two supporting surfaces 18.1 are set at an angle to one another. The angular alignment of supporting surfaces 18.1 is adapted to the alignment of supporting surfaces 29 of bit holder 20, so that supporting surfaces 29 of bit holder 20 can abut in plane-parallel fashion onto supporting surfaces 18.1 of base part 10. For purposes of defined contact of bit holder 20, supporting surfaces 18.1 are interconnected via a setback step 18.4. Insertion receptacle 15 is bounded at the back by a countermember 16. Countermember 16 is part of a rearward projection 17 that protrudes beyond insertion receptacle 15 oppositely to the tool advance direction (V). Countermember 16 is constituted by two further supporting surfaces 16.1 that are at an angle to one another. These further supporting surfaces 16.1 are again embodied, in terms of their conformation and spatial arrangement, in a manner adapted to bearing surfaces 21.5 of bit holder 20, so that plane-parallel contact of the further bearing surfaces 21.5 against supporting surfaces 16.1 is possible. Oppositely to supporting surfaces 18.1, insertion receptacle 15 is bounded by an open surface 18.2. In the tool advance direction (V), insertion receptacle 15 is bounded by two lateral connecting segments 19. The inner surfaces that are formed by connecting segments 19 and face toward insertion receptacle 15 transition via open surfaces 18.5 into walls 18.6 that again are oriented in the tool advance direction (V). Walls 18.6 in turn transition into open surface 18.2. As is clearly evident from FIG. 9, a cutout 17.1 is countersunk into projection 17.

Installation of bit holder 20 on base part 10 is performed as follows.

Firstly bit holder 20 is inserted with its insertion projection 21 into insertion receptacle 15 of base part 10. As may be gathered from FIG. 5, a setscrew constituting fastening element 14 is then screwed into screw receptacle 13. Fastening element 14 comprises a pressure application surface, oriented at right angles to the screw axis, that comes into contact against pressure surface 21.2 of bit holder 20. The pressure application surface does not need to be a planar surface, but can also be a spherical surface. It may be gathered from FIG. 1 that two fastening elements 14 are used to fasten bit holder 20, and therefore two screw receptacles 13 are also recessed into base part 10. Upon tightening of fastening elements 14, fastening element 14 presses onto pressure surface 21.2. Because of the angled incidence of pressure surface 21.2 with respect to longitudinal center axis L of insertion protection 21, fastening element 14 exerts a pull-in force on insertion projection 21. Simultaneously, a force component is generated which extends oppositely to the tool advance direction (V) and presses insertion projection 21 into countermember 16. The force component extending in the direction of longitudinal axis L of insertion projection 21 brings supporting surfaces 18.1 of support mount 18 into contact with supporting surfaces 29 of bit holder 20. As is clearly apparent in particular from FIG. 5, tightening of fastening elements 14 causes bit holder 20 to experience bracing on both sides of longitudinal center axis L of insertion projection 21. Bracing is performed on the one hand against countermember 16 on the back side of the longitudinal center axis at the insertion-projection end of bit holder 20, and on the other hand against support mount 18 on the front side of the longitudinal center axis at the holding-projection end of the bit holder. Support surfaces 29 and bearing surfaces 21.5 are consequently located diametrically oppositely on bit holder 20. Fastening screw 14 then acts on insertion projection 21 in such a way that a tightening of bit holder 20 against support mount 18 and against countermember 16 takes place. Secure and lossproof fastening of bit holder 20 is thereby guaranteed.

It may further be gathered from FIG. 5 that a cover element 14.1, which covers the tool receptacle of fastening element 14, can be inserted into orifice enlargement 13.1 of screw receptacle 13.

Both base part 10 and bit holder 20 are embodied substantially mirror-symmetrically with respect to the transverse center plane, extending in the tool advance direction (V), of these respective components. This promotes homogeneous load dissipation.

During operational use, a round shank bit of usual design inserted into bit receptacle 26 engages into the material to be removed, for example a coal seam. It is predominantly the bracing system, made up of support mount 18 and supporting surfaces 29, that is stressed in the context of this engagement. During tool engagement, bit holder 20 is also pressed into countermember 16 as a result of the tool advance (V). The large-area contact of bit holder 20 there ensures reliable energy dissipation. As may be gathered from FIG. 5, an unequivocal correlation between bit holder 20 and base part 10 is guaranteed in particular by the fact that contact takes place only at these two aforementioned central supporting points (support mount 18 and countermember 16). In the region of setback 18.4, open surface 18.2, walls 18.6 of open surfaces 18.5, and connecting segment 19, insertion projection 21 is clear of insertion receptacle 15. When, for example, wear on supporting surfaces 18.1 takes place in the course of utilization of base part 10, setback 18.4 then forms a resetting space. The spacing of bit holder 20 away from setback 18.4 ensures resetting of bit holder 20 in the event of wear. Wear compensation can take place in particular because supporting surfaces 18.1 and further supporting surfaces 16.1 form slide guides along which bit holder 20 can slip upon re-tensioning. This configuration is advantageous in particular when, as is usually required, base part 10 has a service life that lasts through several life cycles of bit holders 20. Unworn bit holders 20 can then always be reliably secured and held even on a partly worn base part 10.

During operational use, removed material is removed by the incorporated round shank bit and slides along bit holder 20 in the region of enveloping surface 25.2. This removed material is directed outward by enlargements 28, thereby providing protection of base part 10 from the abrasive attack of this removed material.

FIGS. 11 and 12 show the installed correlation between bit holder 20 and base part 10. Base part 10 is placed with its concave underside 11 onto the convex outer side of a tubular milling drum and welded in place there. A shank bit, namely a round shank bit 50, is inserted in known fashion into bit receptacle 26 of bit holder 20. Round shank bit 50 comprises a bit tip 51, made of hard material, that is fastened on a bit head 52. Adjoining bit head 52 is a bit shank that is held in bit receptacle 26 by means of a clamping sleeve (not shown in the Figures). By means of the clamping sleeve, round shank bit 50 can be held in bit receptacle 26 in lossproof fashion in an axial direction, but freely rotatably around its longitudinal center axis M. Bit head 52 is braced with respect to abutting surface 25.3 with interposition of a wear protection washer 53. FIG. 11 shows round shank bit 50 in the unworn state. During operational use, the tool combination shown rotates around the longitudinal center axis of the tubular milling drum, in which context the cutting insert rotates with its radially outer dimensional boundary on a reference circle $T_3$ having a third diameter. The radially outer boundary of cutting edges 46 rotates on a reference circle $T_2$ having a second radius. Reference circle $T_1$ shown in FIGS. 11 and 12, having a first radius, represents the maximum permissible wear state of hard-material elements 40.

As may be gathered from FIG. 11, cutting edges 46 are arranged set back in a radial direction with respect to reference circle $T_3$, so that the second radius of reference circle $T_2$ is smaller than the third radius of reference circle $T_3$.

The maximum permissible wear state of cutting element 51 and of round shank bit 50 may be gathered from FIG. 12. As this drawing illustrates, the radially outer boundary of cutting element 51 is now located on reference circle $T_2$, so that cutting elements 46 are now also coming into engagement with the material to be removed. Hard-material elements 40 thus constitute an emergency-mode property which prevents the front receiving region of the bit receptacle (abutment 25.3) from becoming worn or damaged.

FIGS. 13 and 14 further illustrate the operating states shown in FIGS. 11 and 12. As FIGS. 13 and 14 show, a plurality of tool systems, each made up of a base part 10, a bit holder 20, and a round shank bit 50, are fastened on the cylindrical surface 61 of a tubular milling drum 60. For clarity, only some of the tool systems are depicted. It is nevertheless clear to one skilled in the art that a plurality of tool systems are mounted over the entire peripheral surface of tubular milling drum 60, distributed in a helical correlation, in order to form clearing and loading screws. FIG. 13 shows the unworn state of round shank bits 50, illustrating that only cutting elements 51 and not hard-material elements 40 are in engagement with that seam F of ground B which is to be processed.

FIG. 14 shows the state of round shank bits 50 when the wear limit is reached. As the drawing shows, hard-material elements 40 are now coming into engagement with seam F.

When a round shank bit is worn out, it can easily be replaced. This becomes possible because cutouts 17.1 in base part 10 form, together with recess 24 in bit holder 20, a tool receptacle. Into this can be inserted a removal tool that acts on the back side of the round shank bit and pushes it out of bit receptacle 26, and also pulls a new round shank bit back in. As may be gathered from FIG. 5, bit receptacle 26 is physically connected to recess 24.

The invention claimed is:

1. A bit holder for an earth working machine, the earth working machine including a working drum rotatable in a tool advance direction and defining a radial direction relative to a rotational axis of the working drum, the bit holder comprising:

a holding projection including a forward end face having a bit receptacle defined in the forward end face, the bit receptacle including a receiving end for receiving a cutting bit, the holding projection being configured such that when the bit holder is mounted on the working drum the forward end face faces partially forward in the tool advance direction and partially radially outward;

a wear protection element attached to the holding projection behind the forward end face, the wear protection element including a hard-material element harder than the holding projection, the hard-material element being arranged to engage the earth in the event of wear or breakage of the cutting bit; and a carrier welded to the bit holder;

wherein the hard-material element is received in the carrier.

2. The bit holder of claim 1, wherein:

the hard-material element is located on a radially outer region of the holding projection and extends radially outward at least as far as a radially outermost surface of the holding projection.

3. The bit holder of claim 1, wherein:

the hard-material element is located on a radially outer region of the holding projection and extends radially outward beyond a radially outermost surface of the holding projection.

4. The bit holder of claim 1, wherein:

the hard-material element is located on a radially outer region of the holding projection and is arranged such that the hard-material element is radially set back from a cutting tip of an unworn cutting bit received in the bit receptacle.

5. The bit holder of claim 1, wherein the hard-material element includes a cutting edge.

6. The bit holder of claim 5, wherein the hard-material element includes a front side facing in the tool advance direction, and a top side, and the cutting edge is defined by an intersection of the front side and the top side.

7. The bit holder of claim 6, wherein:

the front side and the top side enclose an angle in an angle range of from 60° to 130°.

8. The bit holder of claim 7, wherein:

the angle range is from 90° to 120°.

9. The bit holder of claim 6, wherein:

the bit receptacle includes a longitudinal center axis; and the longitudinal center axis of the bit receptacle and the front side of the hard-material element enclose an angle in an angle range of from 40° to 130°.

10. The bit holder of claim 9, wherein:

the angle range of the angle between the longitudinal center axis of the bit receptacle and the front side of the hard-material element is from 60° to 110°.

11. The bit holder of claim 1, wherein the hard-material element comprises two or more hard-material elements arranged side by side in gap-free fashion.

12. The bit holder of claim 1, wherein:

the hard-material element is received in a recess of the bit holder and is braced positively against a supporting surface located behind the hard-material element with reference to the tool advance direction.

13. The bit holder of claim 12, wherein:

the hard-material element is braced positively in the tool advance direction against a step.

14. The bit holder of claim 1, wherein the hard-material element is made of carbide.

15. The bit holder of claim 1, wherein the hard-material element is made of a ceramic material.

16. The bit holder of claim 1, wherein:

the carrier includes a base part and at least one rearward extending supporting part, the hard-material element being received in the base part.

17. The bit holder of claim 1, wherein:

the bit holder includes a convex enveloping surface; and the carrier includes a concave placement surface configured for attachment to the convex enveloping surface of the bit holder.

18. The bit holder of claim 1, wherein:

the carrier includes a chamfer on an edge region to provide a weld bead preparation.

19. A bit holder for an earth working machine, the earth working machine including a working drum rotatable in a tool advance direction and defining a radial direction relative to a rotational axis of the working drum, the bit holder comprising:

a holding projection including a forward end face having a bit receptacle defined in the forward end face, the bit receptacle including a receiving end for receiving a cutting bit, the holding projection being configured such that when the bit holder is mounted on the working drum the forward end face faces partially forward in the tool advance direction and partially radially outward;

a wear protection element attached to the holding projection behind the forward end face, the wear protection element including a hard-material element harder than the holding projection, the hard-material element being arranged to engage the earth in the event of wear or breakage of the cutting bit; and a carrier connected to the holding projection, the carrier having a recess defined therein by a rear supporting surface and a forward step; and wherein the hard-material element is received in the recess of the carrier and is braced against the supporting surface and the step.

20. A wear protection element for a bit holder for an earthworking machine, comprising:

a carrier including an underside, an upper side, a front side, a rear side, and first and second lateral sides;

the underside including a concave placement surface having a concave curvature in lateral cross-section;

the upper side including a recess defined in part by forward and rearward supporting surfaces; and a hard-material element, harder than the carrier, received in the recess and supported by the forward and rearward supporting surfaces.

21. The wear protection element of claim 20, wherein:

the recess extends laterally from the first lateral side to the second lateral side; and the hard-material element includes a plurality of laterally side by side segments received in the recess and extending from the first lateral side to the second lateral side.

22. The wear protection element of claim 20, wherein:

the carrier includes a forward base part and two rearward extending supporting parts, the supporting parts having a gap therebetween; and the recess is defined in the base part.

23. The wear protection element of claim 20, wherein: the hard-material element includes a front side and a top side defining a cutting edge at an intersection of the front side and the top side.

24. The wear protection element of claim 23, wherein: the front side and the top side enclose an angle in a range of from 60° to 130°.

25. The wear protection element of claim 24, wherein the angle is from 90° to 120°.

26. The wear protection element of claim 20, wherein: the recess includes a recess bottom supporting the hard-material element and sloped forward.

* * * * *